United States Patent [19]

Yazaki

[11] Patent Number: 4,568,293

[45] Date of Patent: Feb. 4, 1986

[54] AIR INTAKE ARRANGEMENT FOR A SMALL BOAT

[75] Inventor: Mitsuhiro Yazaki, Kakogawa, Japan

[73] Assignee: Kawasaki Jukogyo Kabushiki Kaisha, Kobe, Japan

[21] Appl. No.: 688,561

[22] Filed: Jan. 3, 1985

[30] Foreign Application Priority Data

Jan. 12, 1984 [JP] Japan ..... 59-2954

[51] Int. Cl.[4] ..... B63H 21/10

[52] U.S. Cl. ..... 440/88; 114/270; 114/211

[58] Field of Search ..... 114/270, 211; 440/88, 440/89; 180/54 A

[56] References Cited

U.S. PATENT DOCUMENTS 3,369,518 2/1968 Jacobson ..... 114/270

3,826,220 7/1974 Jacobson ..... 114/270

4,509,926 4/1985 Jacobson ..... 440/89

*Primary Examiner*—Galen L. Barefoot

*Assistant Examiner*—Jesûs D. Sotelo

*Attorney, Agent, or Firm*—Marshall, O'Toole, Gerstein, Murray & Bicknell

[57] ABSTRACT

This disclosure relates to an air intake arrangement for a small boat including a hull, wherein the front end of a handle pole of the boat is supported pivotably on a horizontal shaft on the upper deck of the hull at a position which is on the longitudinal center line of the hull, and a handle lever to be held by an operator is attached to the rear end of the handle pole. An air intake port for taking fresh air into the engine compartment in the interior of the hull is provided on substantially the center line at a position corresponding to the lower side of the handle pole on the deck, and a lead-in opening for taking the air from the front of the boat and leading it into the air intake port is formed in the handle pole.

10 Claims, 6 Drawing Figures

FIG. 3
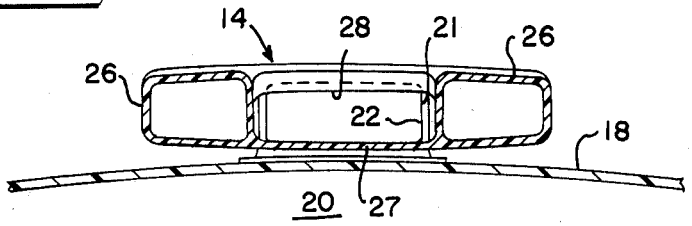
FIG. 4
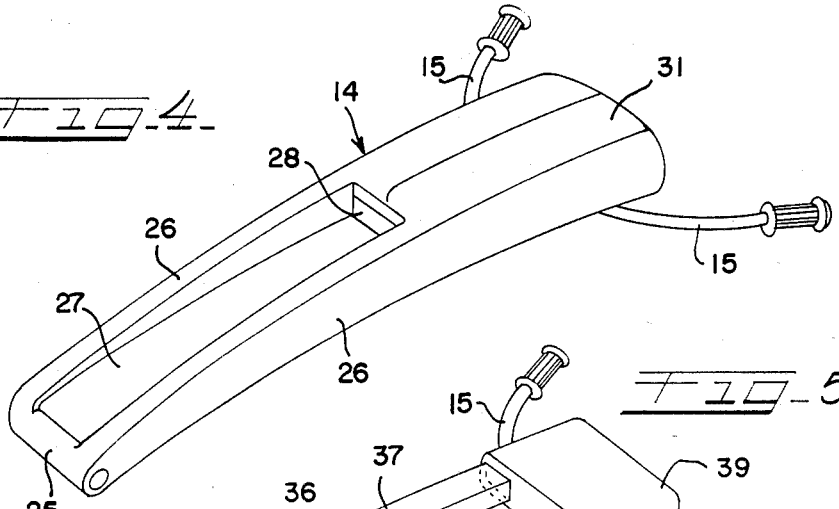
FIG. 5
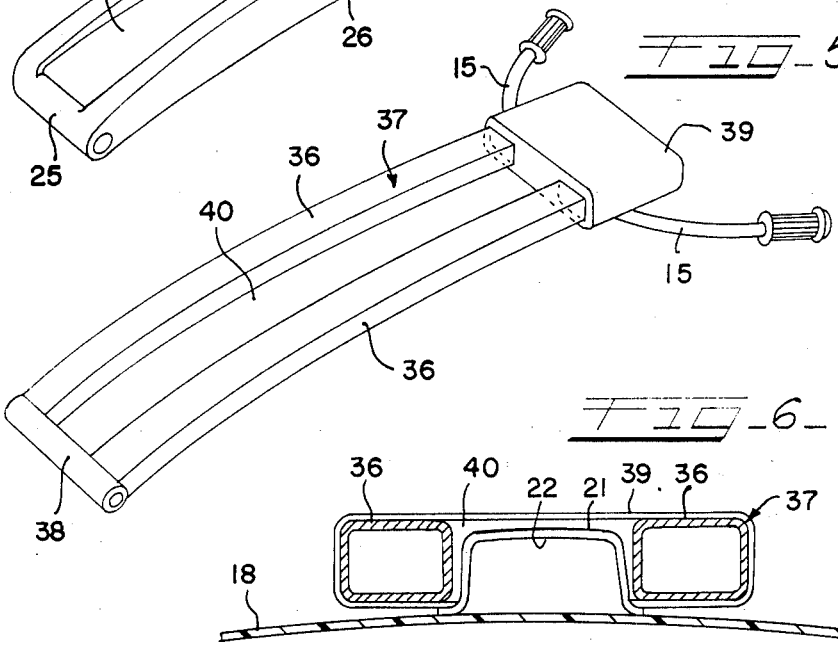
FIG. 6

AIR INTAKE ARRANGEMENT FOR A SMALL BOAT

BACKGROUND OF THE INVENTION

This invention relates to an arrangement for taking fresh air into the engine compartment of a small boat. For example, the small boat may be of the type which glides on the water while being steered by a person in standing position or sitting position. Prior art boats of this character include a detachable engine cover which is part of the deck and forms the upper part of the hull. In such a case, as disclosed in the Japanese Patent Provisional Pub. No. 49-58587, an air intake port is formed at the front end and an exhaust port is provided at the rear end, so that the engine compartment formed inside the engine cover may always be ventilated. Since the prior art air intake port and the exhaust port are located on the longitudinal center line of the hull, the ports are advantageously located because entry of water may be prevented if the hull rolls in either right or left direction, but it is difficult to take in air from the front because the bow and the bracket for handle pole are located in front of the air intake port. To remedy this difficulty, in addition to the air intake port, an air intake duct of the forward opening type projects from the engine cover, and an air intake port is formed at the front end of this air intake duct.

In this case, however, since the air intake duct is of projecting type, it is usually disposed at one side of the hull, such as the starboard side, in order to avoid interference with the handle pole which is located on the center line of the hull. With this disposition, it is effective to take in air from the front, but water may also enter the hull through the air intake port if the hull rolls.

Apparatus in accordance with this invention eliminates these prior art defects; that is, it prevents entry of water into the hull if the hull rolls, and also it takes in fresh air effectively from the front whether the boat is running or is stopped.

BRIEF SUMMARY OF THE INVENTION

An air intake arrangement for a small boat is provided in accordance with this invention, wherein the front end of a handle pole of the boat is supported pivotably on a horizontal shaft on the deck at a position which is on the longitudinal center line of the hull, a handle lever to be held by an operator being attached to the rear end of the handle pole. An air intake port for taking fresh air into the engine compartment of the hull is provided on substantially the center line at a position corresponding to the lower side of the handle pole on the deck, and a lead-in opening for taking the air from the front of the boat and leading it into the air intake port is formed in the handle pole.

BRIEF DESCRIPTION OF THE DRAWINGS

This invention may be better understood from the following detailed description taken in conjunction with the accompanying figures of the drawings, wherein:

FIG. 3 is a sectional view taken on the line III—III in FIG. 2;

FIG. 4 is a perspective view of a handle pole of the boat shown in FIG. 1;

FIG. 5 is a perspective view showing another form of the handle pole; and

FIG. 6 is a sectional front view showing the position of the handle pole of FIG. 5 adjacent the engine cover.

DETAILED DESCRIPTION OF THE DRAWINGS

Figure 1:
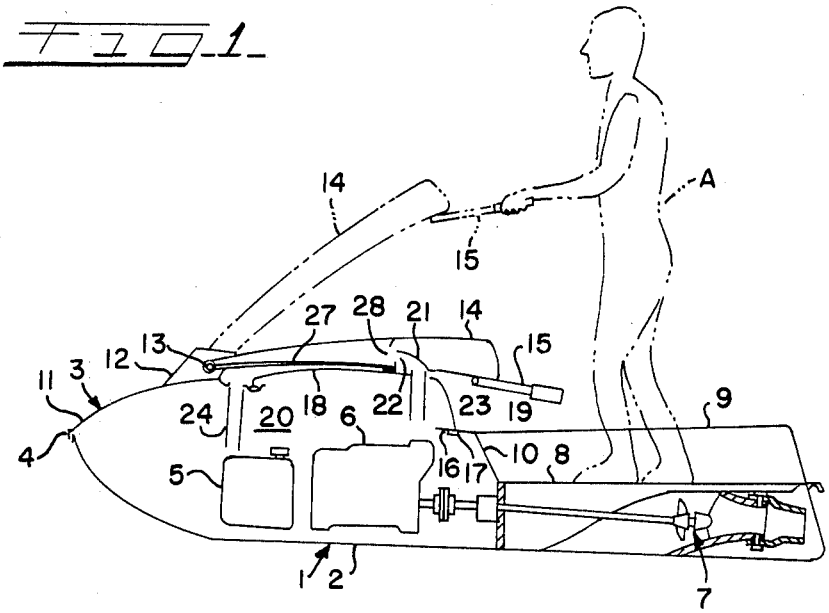
FIG. 1 is a diagrammatic side view of a small boat including an apparatus in accordance with a first embodiment of this invention.

In FIG. 1, the numeral 1 denotes a boat hull constructed, for example, of FRP, in which a lower hull part 2 and an upper deck 3 are joined together at a seam 4 by securing and sealing marginal flanges. The hull 1 forms an engine compartment 20 and a fuel tank 5 and an engine 6 are disposed at the front side of the compartment 20. The engine 6 drives a water jet propulsion device 7 provided at the rear part of the hull 1. The arrangement of the engine and the propulsion device may be conventional and therefore are not illustrated in detail.

A floor 8 is integrally formed in the rear part of the upper deck 3, on which an operator A mounts in either a standing position or sitting position, and at both the right and left sides of this floor 8 are formed upward projecting fins 9. An integral front wall 10 rises to the height of the fins 9 at the front end of the floor 8.

Figure 2:
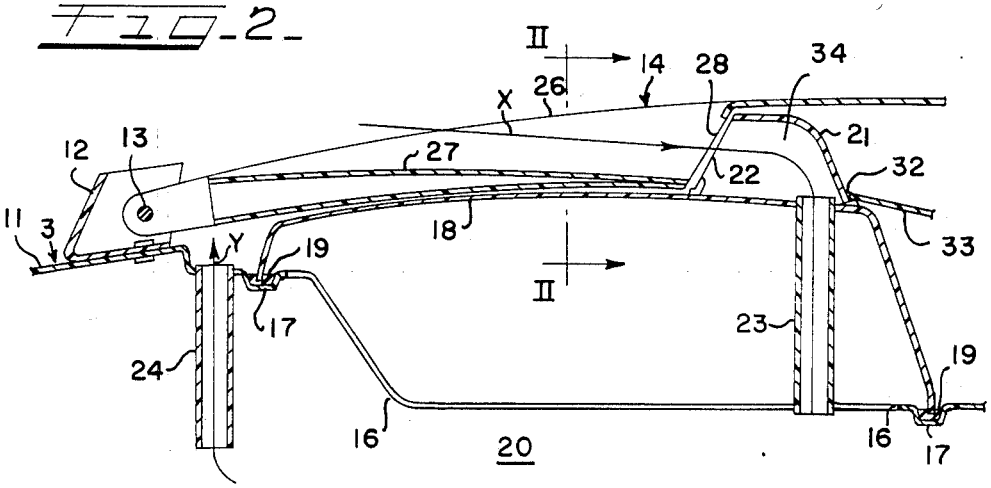
FIG. 2 is an enlarged longitudinal sectional view which better shows part of the structure of FIG. 1.

At the front end of the upper deck 3 is formed a bow 11, and a pivotable handle pole 14 is supported on a horizontal pivot shaft 13 (FIGS. 1 and 2). A handle pole bracket 12 projects upwardly from the rear center part of the bow 11, and the bracket 12 supports the shaft 13. The shaft 13 extends substantially laterally and horizontally, and the handle pole 14 is pivotable in a vertical plane between a lowered position shown in solid lines and a raised position shown in dash-dot lines in FIG. 1. This handle pole 14 is positioned along the center line of the hull in its entire part including the front end, and a handle lever 15 adapted to be held by an operator A is attached to its rear end, as shown in FIG. 1.

The numeral 16 (FIG. 2) indicates a rectangular opening formed in the deck 3 at a position corresponding to the upper side of the engine 6, and a groove 17 is formed around the margin of this opening 16 as shown in FIG. 2. An FRP-made engine cover 18 (FIGS. 1 and 2) forms part of the deck 3, and its peripheral edge is fitted into an annular packing 19 and set in the groove 17, and it is fixed in place by being pushed downward and secured by means of a cover latch (not shown). This cover latch, for example, is made of a tightening band of which front end is secured to the front side of the engine cover 18 on the deck 3 and rear end is detachably connected at the front wall 10 and extends along the upper part of the engine cover 18.

In the upper part of the engine cover 18, which is part of the deck 3, is formed a projecting air intake duct 21 for taking air into the engine compartment 20 in the hull 1, and an air opening port 22 (FIGS. 2 and 3) is opened in the front end of the duct 21. This air intake port 22 is located at a position corresponding to the lower side of the handle pole 14 (see FIG. 2), that is, along the longitudinal center line of the hull.

In the upper wall part of the engine cover 18, within the inside of the air intake duct 21, is mounted an air lead-in pipe 23 which extends through the wall of the cover 18 and downwardly into the engine compartment 20 adjacent the engine 6, and a generally similar exhaust pipe 24 is mounted adjacent the front side of the engine cover 18 and extends through the deck 3 in order to discharge the air taken into the engine compartment 20. This exhaust pipe 24 is also positioned on the center line of the hull and is just behind the bracket 12.

The handle pole 14 is formed, for example, integrally of FRP. With reference to FIGS. 3 and 4, the handle pole 14 includes two laterally spaced side parts 26 which extend rearwardly from a supporting boss 25 at the pivot shaft 13, and an air lead-in wall 27 is integrally formed between the two side parts 26. The wall 27 extends across the lower side of the handle pole 14 and is flush with the bottom sides of the two side parts 26. By contrast, the rear part 31 is entirely formed in a substantially rectangular cross section like an ordinary handle pole of a conventional small boat, except that an opening 32 is formed in the bottom wall 33 of the part 31, the air intake duct 21 extending upwardly through the opening 32 when the handle pole 14 is in the lowered position (see FIG. 2).

At the position corresponding to the rear end of the air lead-in wall of the handle pole 14, a lead-in opening 28 (FIGS. 2–4) is formed in the front wall of the part 31 at a location where it is immediately in front of the air intake port 22 of the duct 21 when the handle pole 14 is lowered against the engine cover 18 as shown in FIG. 2. This lead-in opening 28 is also located on the center line of the hull.

Consequently, when the handle pole 14 is lowered and is on the engine cover 18, the lead-in opening 28 of the handle pole 14 is aligned with and communicates the air to the intake port 22. Therefore, when the boat is at standstill and the handle part 14 is lowered, the fresh air is introduced along the upper side of the wall 27 and into the air intake port 22 through the lead-in opening 28 as indicated by arrow X in FIG. 2, and is taken into the engine room 20 through the duct 21 and the air lead-in pipe 23. In this case, since there is no obstacle in front of the air path, the air may be taken in effectively, whether the boat is stopped or running when the handle pole 14 is lowered. The air taken into the engine room 20 is discharged out of the hull 1 through the front exhaust pipe 24 as indicated by arrow Y in FIG. 2.

On the other hand, when the boat is gliding on the water and the handle pole 14 is in the raised position, the air is effectively taken in through the air intake port 22, the air readily flowing around the bracket 12 and the forward end of the handle pole 14. If the hull 1 rolls unexpectedly, since the air intake port 22 is located on the center line of the hull and is at substantially the highest point of the hull, water will not get inside through this air intake port 22. The duct 21 includes longitudinal side walls 34 which also help to prevent the entry of water if the boat rolls to one side. Moreover, the air lead-in wall 27 and the two side parts 26 substantially enclose the port 22 when the handle pole is lowered, so that water splashes are not able to enter the engine compartment through the air intake port 22.

A second embodiment of the handle part is shown in FIGS. 5 and 6. In this case, as shown in FIG. 5, two side parts 36 of the handle pole 37 are formed by a pair of square pipes made, for example, of aluminum, and the front ends of the two pipes 36 are linked by a lateral support pipe 38, while the rear ends of the two pipes are linked by a generally rectangular case lever mounting bracket 39 as shown in FIGS. 5 and 6. In this embodiment, the handle pole does not include an air lead-in wall 27 as shown in FIG. 4, but a lead-in opening 40 corresponding to the opening 28 is formed by the entire space between the two pipes 36 as shown in FIG. 5. In this case, too, since the lead-in opening 40 concentrically corresponds to the front of the air intake port 22, the spontaneous ventilation while the boat is stopped and the handle pole is lowered is effected similarly to the first embodiment.

As will be apparent from the foregoing, since the air intake port for taking fresh air into the hull is provided at a high level on the center line of the hull, at a position corresponding to the lower side of the handle pole in the upper part of the deck, and a lead-in opening for taking in the air from the front and introducing it into this air intake port is formed in the handle pole, entry of water into the hull is prevented if the hull rolls, and the air can be taken in from the front effectively whether the boat is running or stopped.

What is claimed is:

1. Air intake apparatus for a small boat, comprising a hull having a longitudinal center line, a longitudinally extending handle pole having a front end and a rear end, means for pivotably supporting said front end of said handle pole on the upper side of said hull along substantially said center line of said hull, said handle pole being pivotable between a lowered position where it extends closely adjacent said upper side of said hull and a raised position where it is angled rearwardly and upwardly from said pivotable supporting means, an air intake port formed in said hull for taking air into the hull, said port being substantially on said center line at a position adjacent the lower side of said handle pole when said handle pole is in said lowered position, and said handle pole forming a lead-in opening for conducting air from the front of said hull and leading it into said air intake port when said handle pole is in said lowered position.

2. Apparatus according to claim 1, wherein said handle pole comprises a pair of spaced side parts which extend longitudinally on opposite sides of said center line, and a rearward part which connects the rearward ends of said side parts, said lead-in opening extending longitudinally between said side parts.

3. Apparatus according to claim 2, wherein said air intake port is located between said pair of side parts and closely adjacent said rearward part.

4. Apparatus according to claim 2, wherein said handle pole further includes an air lead-in wall which extends along the bottom of said side parts and conducts air to said air intake port.

5. Apparatus according to claim 2, wherein said hull further includes an upwardly extending duct and said air intake port is formed on the front side of said duct, said duct extending between said side parts when said handle is in said lowered position.

6. Air intake apparatus for a small boat comprising a hull having an upper side and a longitudinal center line, an elongated handle pole extending generally along said center line, means pivotably mounting said pole for swinging movement between raised and lowered positions, said pole extending closely adjacent said hull when in said lowered position and slanting upwardly and rearwardly when in said raised position, said hull forming an interior engine compartment, and air intake means formed on said upper side of said hull, said pole including two laterally spaced side parts, and said side parts being closely adjacent and on opposite sides of said intake means when said pole is in said lowered position.

7. Apparatus according to claim 6, and further including a wall forming a longitudinally extending lead-in path located forwardly of said intake means and between said side parts.

8. Apparatus according to claim 7, wherein said wall is formed on said upper side of said hull.

9. Apparatus according to claim 7, wherein said wall is formed on said handle pole and is connected between said side parts.

10. Apparatus according to claim 6, and further including an exhaust port formed in said hull closely adjacent and rearwardly of said mounting means.

* * * * *